United States Patent [19]

Bruce

[11] 4,147,254

[45] Apr. 3, 1979

[54] FREE-STANDING CARRYING CASE FOR MUSICAL INSTRUMENT

[75] Inventor: Jeffrey S. Bruce, Oakland, Calif.

[73] Assignee: Stagehand Associates, Oakland, Calif.

[21] Appl. No.: 815,526

[22] Filed: Jul. 14, 1977

[51] Int. Cl.[2] ..... A45C 11/00; B65D 85/54

[52] U.S. Cl. ..... 206/314; 150/52 R; 190/29; 206/45.23

[58] Field of Search ..... 206/314, 14, 45.2, 45.23; 150/52 R; 190/37, 19, 13 R, 29; 84/DIG. 17, 45.3; 224/5 S; 248/443, 453, 461

[56] References Cited

U.S. PATENT DOCUMENTS

| | | | |
|---|---|---|---|
| 808,295 | 12/1905 | Mendel | 190/19 |
| 923,807 | 6/1909 | Bonsall | 190/13 R |
| 973,500 | 10/1910 | Gunther | 200/14 |
| 1,135,428 | 4/1915 | Belber | 190/19 |
| 1,180,496 | 4/1916 | Heilman | 190/13 R |
| 1,352,814 | 9/1920 | Kirk | 206/314 |
| 2,156,910 | 5/1939 | Brooks | 206/14 |
| 3,719,284 | 3/1973 | Rasmusson et al. | 248/453 |
| 3,809,231 | 5/1974 | Palma et al. | 206/314 |

FOREIGN PATENT DOCUMENTS

| | | | |
|---|---|---|---|
| 25535 | 2/1920 | Denmark | 206/14 |
| 1147916 | 1/1968 | United Kingdom | 190/28 |

*Primary Examiner*—William Price
*Assistant Examiner*—Joseph M. Moy
*Attorney, Agent, or Firm*—Warren, Chickering & Grunewald

[57] ABSTRACT

A carrying case for a musical instrument or the like is disclosed in which a movable portion of the carrying case is mounted to the remainder of the carrying case for movement to an open position at which position the movable portion and the remainder of the body of the carrying case will support the carrying case in a stable, upright, freestanding position on a horizontal surface. The movable portion takes the form of a pair of front panels hingedly mounted to side panels, which are in turn hingedly mounted to the remainder of the carrying case to enable a double hinged opening of the carrying case until the front panels extend rearwardly of the carrying case and provide a highly stable support apparatus. The carrying case further includes means for releasably retaining the instrument in the carrying case and tray means mounted to provide a convenient equipment support surface.

9 Claims, 10 Drawing Figures

FREE-STANDING CARRYING CASE FOR MUSICAL INSTRUMENT

BACKGROUND OF THE INVENTION

Considerable effort has been directed toward the evolution of carrying cases for musical instruments, and particularly stringed instruments. U.S. Pat. Nos. 3,901,384, 3,326,359 and 361,817 disclose musical instrument carrying cases for stringed instruments in which various combinations of shock absorbing padding, foam materials and instrument clamping or retaining devices are employed to insulate the instrument against damage while being carried in the case. While these patents presumably disclose carrying case constructions which are highly effective in solving the problems of transport and storing of instruments without damage, they are of little assistance of musicians at the time of performance with the instrument.

Similarly, effort has been directed toward providing carrying cases for musical instruments which either disguise or enhance the appearance of the carrying case during transport or storage. U.S. Pat. Nos. 308,077, Des. 209,091 and Des. 205,723 are examples of carrying cases for stringed instruments in which the appearance of the case is the primary consideration.

Most pertinent of the present invention are U.S. Pat. Nos. 1,772,308, 414,231 and 303,745, which disclose carrying cases for stringed instruments which also have function or utility at the time of performance. These cases act as a stand or support either for the instrument or for the music to be played. In each of these prior art patents, however, the approach has been to provide a set of auxiliary supporting legs that are either foldably or removably attached to the carrying case so that such supporting structures can be selectively deployed for support of the carrying case on a generally horizontal surface. Unfortunately, such prior art apparatus has often been awkward and cumbersome in its use and appearance, and such apparatus is often undesirably complex, bulky to store, time consuming to deploy and of questionable stability when deployed.

It is quite common today, particularly in connection with popular music, for a musician to perform several instruments during a concert, or even a single piece of music. Thus, a guitar player may well play both acoustic and electric guitar, while a saxophone player might also play the clarinet. The musician, therefore, often needs a structure or apparatus in which he can temporarily store a secondary instrument or even his primary instrument while doing some other activity, for example, singing. While prior art carrying cases have acted as music stands, they have not been designed as structures which can conveniently support a musical instrument in an easily accessible and yet safe and stable position proximate the musician while he is performing.

SUMMARY OF THE INVENTION

Objects of the Invention

Accordingly, it is an object of the present invention to provide a carrying case for musical instruments or the like which can also act as a free-standing, stable, support apparatus to position the instrument in a conveniently accessible orientation proximate the musician during a performance.

It is a further object of the present invention to provide a carrying case for a musical instrument or the like which can be used to provide a convenient surface and/or support for music and equipment related to the musical instrument.

Still a further object of the present invention is to provide a carrying case for a musical instrument or the like which provides a stable, free-standing, upright, support for a musical instrument and yet has a minimum number of components; which may be realtively easily and inexpensively constructed; is durable and high in strength; and can be rapidly and conveniently deployed.

The carrying case of the present invention has other objects and features of advantage which will become apparent from or are set forth in detail in the description of the preferred embodiment and the accompanying drawing.

Brief Summary

The carrying case for musical instruments of the present invention includes a case body defining an internal cavity dimensioned for receipt of the instrument. The body also has a movable portion, such as a door or lid, formed for movement to and from an open and a closed position. The improved portion of the carrying case of the present invention is comprised of the movable portion being mounted to the body for free-standing, upright, stable support of the carrying case on a generally horizontal surface by engagement of the horizontal surface by a combination of the movable portion when in the open position and the body. In the preferred form, the movable portion takes the form of a pair of front panel portions hinged to side panel portions which in turn are hinged to the remainder of the body along sloped sides thereof. The front opening, double-hinged construction allows the front portions to be swung outwardly and rearwardly to an open position at which the carrying case can be slightly tilted back for support on the rearwardly extending front panel portions and the base or bottom of the carrying case. The case also preferably includes retaining means for releasably holding the instrument in the case against being accidentally jarred or knocked out of the same and a tray means movable to a generally horizontal orientation to provide a convenient surface on which music, auxiliary musical equipment and even the instrument itself can be placed.

DESCRIPTION OF THE PREFERRED EMBODIMENT

Figure 1:
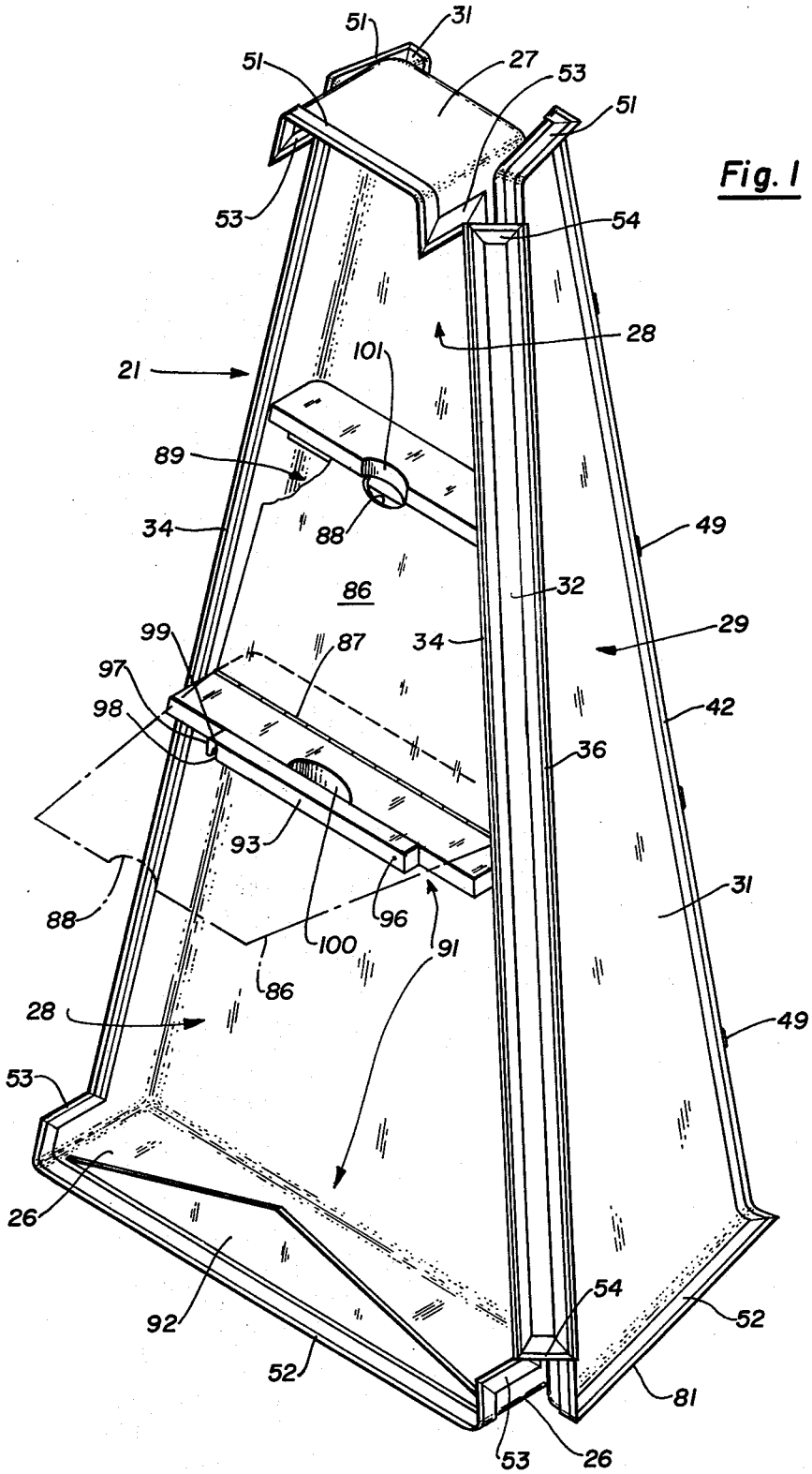
FIG. 1 is a top perspective view of a carrying case in the open position and constructed in accordance with the present invention.
Figure 2:
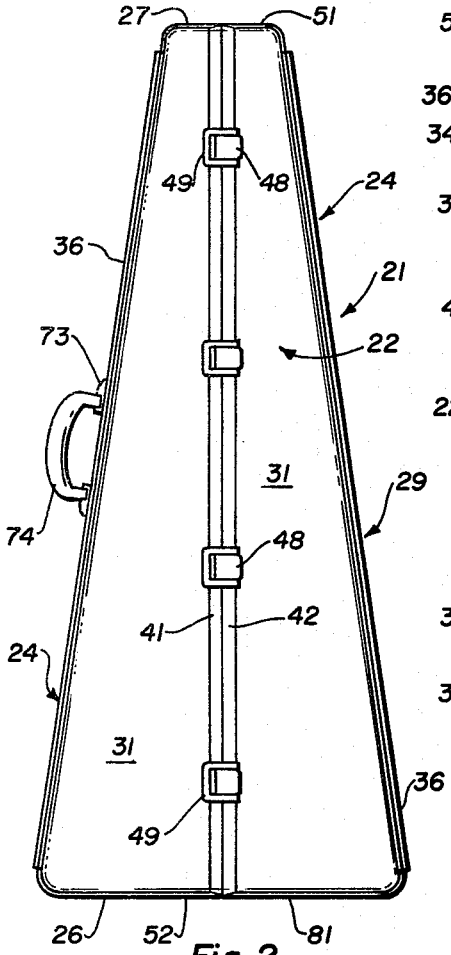
FIG. 2 is a front elevational view, in reduced scale, of the carrying case of FIG. 1, shown in closed position.
Figure 3:
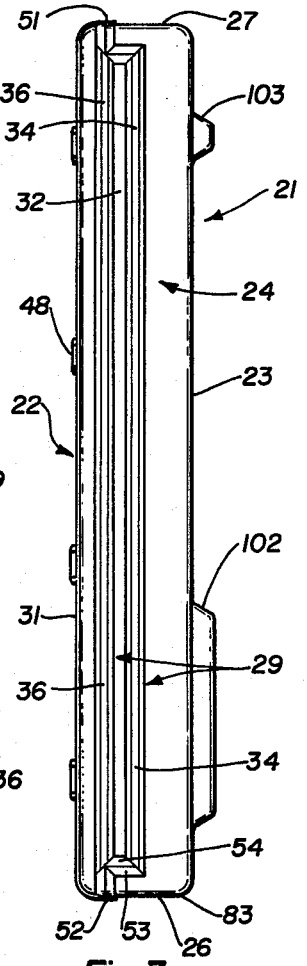
FIG. 3 is a side elevational view of the carrying case of FIG. 2, shown in closed position.
Figure 4:
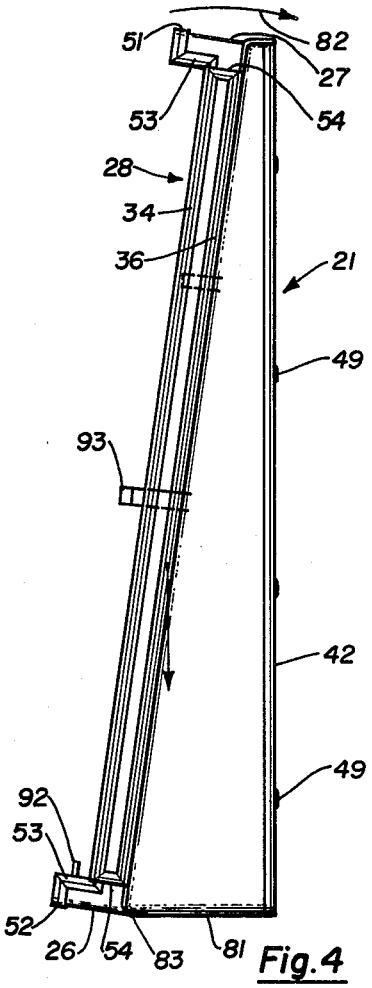
FIG. 4 is a side elevational view of the carrying case of FIG. 2, shown in open position.
Figure 5:
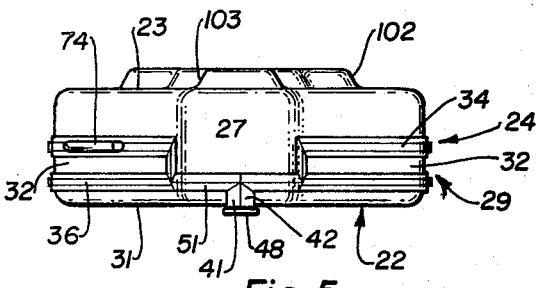
FIG. 5 is a top elevational view of the carrying case of FIG. 2.

Referring now to FIGS. 1 through 5, the carrying case of the present invention can be seen to have a body, generally designated 21, which includes a front, generally designated 22, back 23, sides, generally designated 24, base 26, and top 27. Body 21 defines an internal cavity 28 dimensioned for receipt of a musical instrument (not shown). The case illustrated in the figures is constructed for carrying of a stringed instrument, preferably a guitar, although it will be understood that the advantages of the carrying case of the present invention will accrue for other types of musical instruments and even for articles other than musical instruments. In order to provide access to the cavity 28 of the carrying case, the body is further provided with a movable portion formed for movement to and from an open position (FIGS. 1 and 4) and a closed position (FIGS. 2, 3 and 5). In the embodiment of the invention shown in the drawing, the movable portion or case door or lid is provided by making front 22 and a portion of sides 24 movable outwardly and rearwardly to provide access to cavity 28, as will be described in detail hereinafter.

In its broadest aspect, the improvement of the present invention is comprised of the movable portion, the lid or doors, being mounted to body 21 for free-standing, stable support of the carrying case on a generally horizontal surface by engagement of the horizontal surface by a combination of the movable portion, when in the open position, and the body. In the preferred form of the invention, the movable portion of the carrying case may take the form of a pair of front panel portions or movable members 31, which are connected to a pair of side panel portions 32. In the preferred form, side panel portions 32 are also movable members. The connection between front panels 31 and side panels 32 and further the connection between side panels 32 and the remainder of body 21 of the carrying case is provided by hinge means 29. More particularly, hinge means 29 is comprised of a first hinge element 34, connecting side panel portions 32 to the remainder of body 21, and second hinge element 36, connecting the front panels 31 to the side panels 32 for pivotal movement of these members to the open position of FIGS. 1 and 4. In the open position at least a part of movable members or portions of the case extend rearwardly of the backside 23 of body 21.

It is preferable, in order to provide convenient access to cavity 28 in which the musical instrument is stored, that front panel portions 31 meet at a position proximate the center of front 22 of the body. As will be understood, however, it is possible to employ other constructions which can be pivoted to a position which will support the case in a stable, upright, free-standing position. For example, the entire front 22 of body 21 could be formed as a single panel instead of a pair of panels 32, and the vertically extending edge of the single front panel along one side could be latched to the side of the case. The opposite vertically extending edge of a single front panel version could be hinged as at hinge 36, and possibly hinged also at hinge element 34. Alternatively, the body 21 could be opened along a side and hinged at a position at about one-half of the rear with appropriate hinges, providing access to cavity 28 through a side thereof.

Figure 9:
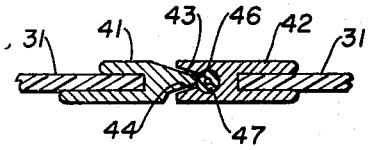
FIGS. 9 and 10 are enlarged, fragmentary, end elevational views, in cross-section, of sealing valance or strip structures suitable for use with the carrying case of the present invention.

In the instrument carrying case shown in the drawing, the front panels 31 are preferably provided with sealing strips or valance members 41 and 42, the details of construction of which can best be seen in FIG. 9. One of strips 41 and 42 is formed with a protruding edge 43 that mates with a corresponding V-shaped socket 44 so that the end 46 of the protruding section bears against a longitudinally extending O-ring 47 to effect a seal between the valance or sealing strip members. Such sealing strips are well known and do not per se form a part of the present invention.

Mounted periodically over the length of the seal strips 41 and 42 are latch or clasp members 48 preferably provided with draw bars 49, which allow the two panels 32 to be drawn toward each other until an effective seal is made between the sealing strips 41 and 42. At least one of the latch apparatus 48 may include a key lock mechanism so as to inhibit unauthorized entry into the case.

Figure 10:
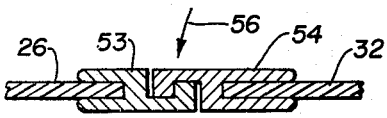

In order to insure sealing along the base and top edges of panels 31, it is preferable that pairs of sealing strips 51 and 52, constructed in the same manner as sealing strips 41 and 42, be used to join the movable front panel members 31 to the stationary base and top portions of the body. In the form of carrying case shown in the drawing, there is a short section which cannot be sealed by means of sealing strips as shown in FIG. 9. Thus, a pair of sealing strips 53 and 54 having the construction shown in FIG. 10 must be employed. These sealing strips are constructed with interfitting protrusions which mate together upon closure of panel 32 in the direction indicated by arrow 56. They seal movable side panel 32 to the remainder of sides 24 at the top and bottom of side panels 32.

Figure 6:
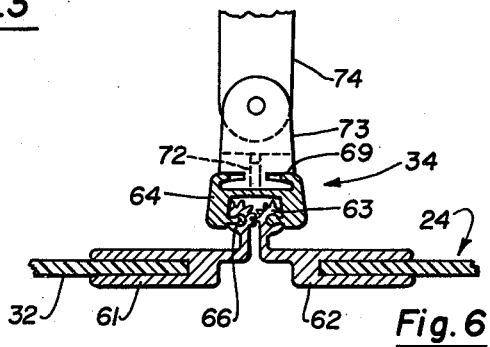
FIGS. 6, 7 and 8 are enlarged, fragmentary, end elevational views, in cross-section, of hinge constructions suitable for use in the carrying case of the present invention, with FIGS. 6 and 7 showing a handle mounting structure.
Figure 7:
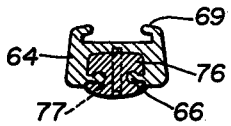
Figure 8:
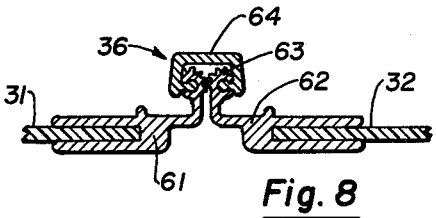

Additionally, and in order to complete the sealing of the interior cavity 28 against pressure changes, moisture, etc., hinge elements 34 and 36 may be advantageously of the type which maintain a seal while still permitting relative hinged movement between the various parts. One such hinge is shown in FIGS. 6 through 8 and is sold under the brand name ROTON by Roton Company of Chicago, Ill. This hinge includes a pair of identical extrusions 61 and 62 having mating and longitudinally extending and interfitting teeth 63, which are held together by a spanning, longitudinally extending, extrusion 64 having a longitudinally extending cylinder portion 66 about which the extrusion 61 and 62 can pivot. The interfitting teeth 63 insures a seal between the parts at the hinge.

The hinge of FIGS. 6 and 7 additionally includes a longitudinally extending channel defined by flanges 69 in which handle mounting member 73 is slidably positioned. A manually engageable handle portion 74 is pivotally mounted between a pair of mounting means 73. A set screw 72 can be used to lock the handle at any predetermined location along the channel provided by flanges 69. This is advantageous since the handle can thereby be set by the musician at a balanced position along the edge of the carrying case, depending upon the center of gravity of the instrument and other equipment that he carries in the carrying case. As can be seen in FIG. 7, the toothed cylindrical members 63 and accordingly the extrusions 61 and 62 are prevented from sliding longitudinally with respect to the spanning element 64 by a longitudinal locking member such as member 76, which can be mounted inside the spanning member 64 and held in a longitudinally locked position by a set screw 77. As will be understood, other hinge and valance constructions are suitable for use with the present invention, and for some carrying cases it is not necessary that the case be able to be closed in a manner sealing cavity 28.

In order to enhance the stability of the carrying case of the present invention, it is preferable that hinge means 29, which pivots the movable portion of the carrying case, be inclined with respect to the vertical. The movable portion of the case is thereby pivoted to a position such that the carrying case is in a normally inclined orientation on the horizontal surface on which it is supported. This may best be seen by reference to FIGS. 1, 2 and 4. As will be seen in FIG. 2, hinges 34 and 36 are inclined or sloped inwardly from base 26 to the top portion 27 of the casing. This results since the sides 24 of the case are inwardly sloped from the base to the top, and the hinges extend along the sides to incline the hinge axis of rotation with respect to a vertical axis or plane.

The inclination of hinges 34 and 36 causes the bottom edges 81 of front panels 31 to be inclined when the front panels are pivoted to the fully opened position. When the front panels are pivoted, for example, by 180° about hinge 36, the bottom edge 81 will become inclined upwardly from its horizontal position of FIG. 2 to an angle equal to twice the slope of the hinge elements from the vertical. This would merely result in the front panels extending outwardly, but not rearwardly, of the casing. When the casing is then pivoted an additional 90° about hinge 34, the front panels 31 now approximate a position parallel to sides 24 of the casing and extend rearwardly of the casing, as is shown in FIG. 4. Thus, at this position, the front panels 31 have been rotated approximately 270°, with the result that the bottom edge 81 of front panel 31 is now inclined upwardly from the horizontal at an angle equal to the inward slope of the hinges 34 and 36. The casing can then be tilted backwardly, as indicated by arrow 82, so as to pivot about a rear edge 83 of the base 26 of the casing until the edge 81 rests on the horizontal supporting surface.

Since the lower rear edge 83 of the base is formed with a substantial width dimension (so that it engages the horizontal supporting surface at substantially laterally spaced apart positions), and since the lower edges 81 of the front panels also engage the supporting surface over a substantial distance in a direction transverse of rear edge 83, the center of gravity (C.G.) of the case will be positioned over the area bounded by the lower rear edge 83 of the base and the bottom edges 81 of the front panels. This produces an extremely stable carrying case orientation.

The use of ROTON hinges in the carrying case of the present invention also has the advantage of further enhancing the stability of the casing. ROTON hinge 34, when pivoted to the open position will cause movable panel 32 to be displaced outwardly of the remainder of side 24 by about a distance of 1 inch. Although not shown in a fully opened position in FIG. 1, panel 32 can, by reason of the outward displacement of ROTON hinge 34, be pivoted about 180° so that panel 32 is about parallel to the remainder of side 24 of the casing wall. This position is shown in FIG. 4. Additionally, the second ROTON hinge 36 enables front panels 31 to be pivoted to a position somewhat beyond 270° so that the bottom edges 81 converge toward each other behind back 23 of the case. This conveying of the front panels provides, with rear edge 83, a triangular support structure for the carrying case which is extremely stable.

The geometry of the casing which enables inclination of hinge means 29 readily adapts the stringed instruments and can be varied to increase the stability of the casing by increasing the slope of the sides 24 of the casing from the base to the top. In practice, however, an inward slope of about 8° will cause the case to have a high degree of stability capable of support of virtually all brands of acoustic and electric guitars. This slope should also be sufficient for most other stringed instruments. As will be appreciated, when the casing is tipped backwardly, as indicated by arrow 82, the bottom 26 of the casing will assume an upwardly inclined angle equal to the slope of the side walls 24.

The ability of the musical instrument carrying case of the present invention to be placed on a supporting surface in an upright, free-standing position enables the carrying case to incorporate other features which take advantage of this free-standing capability. Thus, mounted to an internal portion of body 21 and positioned in cavity 28 in tray means 86. The tray means is preferably movably mounted about a pivotal or hinged mount 87 for positioning in a stored position in the cavity and a deployed position. The deployed position, shown in phantom in FIG. 1, is located in a generally horizontal plane when the carrying case is supported on the horizontal surface by the movable panel portions of the case. Thus, tray means 86 affords a convenient surface on which sheet music, guitar strings, picks, and even the instrument itself can be placed for ready access and use by the musician.

As will also be seen, tray means 86 includes a semicircular recess 88 which can be used to enable the tray to be manually engaged and pulled down from the stored position to the deployed position. Additionally, however, recess 88 is preferably formed for receipt and support of the neck portion of a musical instrument such as a guitar when the tray is in a deployed position. The recess 88 provides a cradle in which the neck of a guitar or the like can be rested. One can, therefore, place the base of the guitar on the supporting surface and rest the neck up against recess 88 so that the guitar is held in a stable, slightly inclined position parallel to the body 21 of the carrying case. As will be appreciated, when tray 86 is in a stored position, the instrument can be placed inside the case. Finally, in connection with tray means 86, it is preferable that the tray means be pivotally mounted to body 21 at a spaced distance from the body so as to define a compartment 89 within cavity 28 between the tray and the back surface of the cavity. This compartment can be used for storage of music and other equipment. It should also be noted that, since the body will be inclined slightly as supported by the movable portions of the casing, the tray 86 preferably pivots slightly past a perpendicular angle so that it is horizontal or only slightly inclined from horizontal.

In many instances, the musician may not wish to place the instrument in front of the case or on tray 86. Instead, there is greater security and stability if tray 86 is in the stored position and the instrument is placed inside the storage cavity 28. In this case, it is preferable, in order to provide additional safety, that the carrying case include retainer means, generally designated 91, positioned in cavity 28 and formed to retain the instrument in the cavity when the case is in a free-standing, self-supporting position. Retainer means 91 may advantageously be formed as a base retaining element 92 and a selectively releasable intermediate retaining element 93. Base retaining element 92 can be formed as a triangular member positioned from the back of the inside wall of the case at a distance enabling the musical instrument to be slipped in behind the retaining element. The intermediate retaining element can be formed as a member pivoted at 96 for movement in a plane parallel to the back of the casing and having an end 97 with a V-shaped groove 98 dimensioned to slide over the shank of a shaft or post having an enlarged head 99. To remove the instrument, therefore, one need only pivot intermediate element 94 to an upward position and lift the instrument upwardly and outwardly to free the same from the case. When desired to store the instrument, it can be inserted behind the base retaining element 92 and placed in yokes 100 and 101 dimensioned to support the neck of the instrument. The musician can, thereafter, and at his option, pivot the intermediate retaining element 93 down in front of the neck or leave the element up and rely upon the rearward inclination of the case to gravity support the instrument in the case in a stable and safe position. The advantage of pivoting retaining element 93 to a position in front of the instrument is that if the casing is inadvertently bumped or jarred, the retaining element will keep the instrument from falling forward out of the case. Moreover, when held in by retaining element 93, the entire case can even be tipped over, the projecting portions of top 27 and base 26, (particularly at sealing strips 51 and 52) will prevent the instrument from contacting the supporting surface while retaining elements 92 and 93 hold the same in the case.

It is also preferable that retaining elements 92 and 93 be positioned and be of a thickness such that they are disposed immediately beneath front panels 31 to provide transverse support for the front panels, when in the closed position, against crushing from the outside of the case.

The carrying case of the present invention can be formed of a number of different materials. Advantageously, the panels forming the front, back, sides, top and base of the casing can be formed of a molded plastic which is adhesively secured, crimped or riveted to the requisite extruded hinge elements and sealing strips. In this regard, the back 23 of the casing can include a molded protruding portion 102 which will afford an enlargement in the cavity 28 necessary to accommodate certain brands of guitars and act as a stiffening structure for the back panel of the case. A corresponding outwardly protruding portion 103 can be provided in the back of the casing so that, when the casing is set down on its back surface, it will have a level orientation. Protrusion 103 also provides stiffening for back 23. Additionally, it is preferable that the casing include a shock absorbing and soft lining cushion or cushions. Such lining or cushioning can be permanently affixed or can be retained as snap-in elements. This latter approach is particularly advantageous since it allows a single casing to be adapted to a wide variety of musical instrument configurations by snapping in, or securing by Velcro fasteners or the like, a lining which fills the space between the molded casing walls and the walls of the particular musical instrument.

What is claimed is:

1. A carrying case for a musical instrument or the like including a case body having a base, front, back and connecting sides defining an internal cavity dimensioned for receipt of said instrument, said body having movable portion means formed for movement to and from an open position and a closed position to enable positioning of said instrument in and removal of said instrument from said cavity, wherein the improvement in said carrying case is comprised of:

hinge means mounting said movable portion means to said body to move said portion means to a position extending rearwardly of said back of said body when said movable portion means is in said open position and to elevate a lower edge of said portion means remote of said body at a spaced distance above a generally horizontal support surface to cooperatively support said carrying case in a stable, upright, free-standing position on said horizontal support surface by tilting said carrying case back until said lower edge of said movable portion means remote from said body engages said horizontal support surface and cooperatively supports said carrying case with a rear edge of said base.

2. A carrying case for a musical instrument or the like as defined in claim 1 wherein, said movable portion means forms said front of said body and is mounted to said body by said hinge means is formed to enable pivotal movement of said movable portion to an open position in which said movable portion extends rearwardly of said back of said body.

3. A carrying case for a musical instrument or the like as defined in claim 2 wherein, said movable portion means is provided as a pair of movable members extending transversely from said sides of said body to meet in said closed position at a location proximate the center of said front of said body; and each side movable member includes a side panel portion and a front panel portion, each said side panel portion being mounted by a first hinge element to said body and each said front panel portion being mounted to said side panel portion by a second hinge element.

4. A carrying case for a musical instrument or the like as defined in claim 1 wherein, said pivotal means having an axis inclined with respect to the vertical for movement of said movable portion means to an open position at which said carrying case is supported in a stable, free-standing position on said horizontal surface in an inclined orientation.

5. A carrying case for a musical instrument or the like as defined in claim 4 wherein, said sides of said body are formed to slope inwardly from a base of said body to a top of said body, and said hinge means is mounted to at least one of said sides of said body and said axis of pivotal movement extends along the side of said body on which said hinge means is mounted.

6. A carrying case for a musical instrument or the like as defined in claim 5 wherein, said hinge means is formed for pivotal movement of said movable portion through at least about 270°.

7. A carrying case for a musical instrument or the like as defined in claim 5 wherein, said movable portion means is formed as at least one front panel portion having a generally horizontally extending lower edge and at least one side panel portion, and said hinge means is formed as a first hinge element inclined to the vertical and mounting said side panel portion to said body and a second hinge element inclined to the vertical and mounting said front panel portion to said side panel portion, whereby the combination of pivotal movement of said side panel portion and said front panel portion to said open position causes said edge of said front panel portion to be disposed about parallel to and at the same angle from said horizontal surface as the angle of slope of said sides of said body from said base to said top.

8. A carrying case for a musical instrument or the like as defined in claim 1 wherein, said body is formed with a base having a lower rear edge formed with a substantial width dimension and formed to engage said horizontal surface at substantial laterally spaced apart positions along said edge when said carrying case is supported in a free-standing position on said horizontal surface.

9. A carrying case for a musical instrument or the like as defined in claim 1, and tray means mounted to an internal portion of said body for positioning in said cavity with said instrument, said tray means being movably mounted for positioning in said cavity in a stored position and in a deployed position, said tray means being formed to extend when in said deployed position in a generally horizontal plane when said carrying case is supported by said body and said movable portion on said horizontal surface.

* * * * *

UNITED STATES PATENT AND TRADEMARK OFFICE

CERTIFICATE OF CORRECTION

PATENT NO. : 4,147,254

DATED : April 3, 1979

INVENTOR(S) : Jeffrey S. Bruce

It is certified that error appears in the above-identified patent and that said Letters Patent are hereby corrected as shown below:

In column 1, line 18, after "assistance" delete "of" and insert ---to---.

In column 1, line 27, delete "of" and insert ---to---.

In column 3, line 57, delete "32" and insert ---31---.

In column 5, line 68, delete "the" and insert ---to---.

In column 6, line 18, after "28" delete "in" and insert ---is---.

Signed and Sealed this

*Seventeenth* Day of *July 1979*

[SEAL]

*Attest:*

*Attesting Officer*

LUTRELLE F. PARKER

*Acting Commissioner of Patents and Trademarks*